US005740507A

United States Patent [19]

Ichikawa et al.

[11] Patent Number: 5,740,507

[45] Date of Patent: Apr. 14, 1998

[54] DENSELY PACKED TONER CONTAINER AND METHOD OF PRODUCING THE SAME

[75] Inventors: Hideo Ichikawa; Sunao Ikeda; Nobuhiro Makita, all of Numazu; Michiharu Narushima, Shimizu; Seiji Terazawa; Masakazu Nakada, both of Numazu; Kazuhiko Umemura, Suntoh-gun, all of Japan

[73] Assignee: Ricoh Company, Ltd., Tokyo, Japan

[21] Appl. No.: 630,900

[22] Filed: Apr. 4, 1996

[30] Foreign Application Priority Data

Apr. 7, 1995 [JP] Japan ..... 7-107969
Mar. 19, 1996 [JP] Japan ..... 8-090234

[51] Int. Cl.[6] ..... G03G 15/08

[52] U.S. Cl. ..... 399/262; 222/DIG. 1; 430/120

[58] Field of Search ..... 399/119, 262, 399/263, 272; 222/DIG. 1; 430/107, 111, 120

[56] References Cited

U.S. PATENT DOCUMENTS

| | | | |
|---|---|---|---|
| 4,264,648 | 4/1981 | Ziolo et al. | 430/111 X |
| 4,267,247 | 5/1981 | Ziolo et al. | 430/120 |
| 5,322,198 | 6/1994 | Ichikawa | 222/321 |
| 5,402,918 | 4/1995 | Nishiyama et al. | 222/152 |
| 5,455,662 | 10/1995 | Ichikawa et al. | 399/260 |
| 5,489,976 | 2/1996 | Ichikawa | 399/263 |
| 5,500,719 | 3/1996 | Ichikawa et al. | 399/238 |
| 5,625,438 | 4/1997 | Sugiyama et al. | 399/272 |
| 5,625,441 | 4/1997 | Sugiyama et al. | 399/272 |

FOREIGN PATENT DOCUMENTS

| | | |
|---|---|---|
| 56-118761 | 9/1981 | Japan . |
| 61-28958 | 2/1986 | Japan . |
| 61-28959 | 2/1986 | Japan . |
| 61-28960 | 2/1986 | Japan . |

OTHER PUBLICATIONS

Patent Abstracts of Japan, vol. 95, No. 001, JP-A-07-010101, Jan. 13, 1995.

Patent Abstracts of Japan, vol. 16, No. 311 (M-1277), Jul. 8, 1992, JP-A-04-087901, Mar. 19, 1992.

Xerox Disclosure Journal, vol. 20, No. 3, pp. 245-246, May 1, 1995, Donald Riley, et al., "Method and Apparatus for Filling Refillable Toner Bottles".

*Primary Examiner*—Fred L. Braun
*Attorney, Agent, or Firm*—Oblon, Spivak, McClelland, Maier & Neustadt, P.C.

[57] ABSTRACT

A toner container densely packed with toner to be replenished into a developing unit included in an image forming apparatus, and a method of producing the same. The toner is packed in the container with a ratio of a packing density to a saturation bulk density greater than 1.0, a mean penetration greater than 5.0 mm inclusive, and a standard deviation of penetration not exceeding one-fifth of the mean penetration. The toner can be smoothly and continuously replenished into the developing unit so as to form a number of images matching the amount thereof.

15 Claims, 7 Drawing Sheets

DENSELY PACKED TONER CONTAINER AND METHOD OF PRODUCING THE SAME

BACKGROUND OF THE INVENTION

The present invention relates to a toner container densely packed with toner to be replenished into the developing unit of a copier, facsimile apparatus, printer or similar image forming apparatus, and a method of producing the same.

Today, a copier, facsimile apparatus, printer or similar electrophotographic image forming apparatus is extensively used. This type of apparatus electrostatically forms a latent image on a photoconductive element, develops it with toner in the form of powder, and transfers the resulting toner image to a paper. The apparatus includes a developing unit to which a toner container filled with toner is removably mounted. The toner is replenished from the container to the developing unit via a toner outlet formed in the container. Usually, the container filled with the toner is put on the market as one of supplies independently of the apparatus body.

For the electrophotographic image formation, use made of single-ingredient type magnetic toner containing a magnetic material, or two-ingredient type toner not containing a magnetic material, but mixed with magnetic powder prepared independently of the toner at the time of use. The single-ingredient type toner promotes the miniaturization of the apparatus body because it does not need the separate magnetic powder.

Image forming apparatuses capable of forming images not only in black but also in a desired color or full-color have recently been developed and put to practical use. This is also true with toner for use with such apparatuses.

The problem with many of the toner containers available on the market is that they cannot be filled with a sufficient amount of toner for their capacity. Because the number of images available with such a toner container is small, the container must be frequency replaced. For example, the single-ingredient type magnetic toner is, in many cases, filled in the container with a volume mean particle size of about 7.5 μm to 11.5 μm and a packing density of about 0.30 g/cc to 0.36 g/cc. This packing density is 0.47 to 0.56 times the saturation bulk density. The terms "packing density" and "saturation bulk density" will be defined later.

The low packing density of the toner container is mainly ascribable to the packing method. A predominant packing method uses a hopper in which an auger mounted on an elongate rotary shaft and provided with a spiral blade is disposed. After the hopper has been set on the mouth of the container, the auger is rotated to force toner out of the hopper into the container. The problem with this method is that the toner is introduced into the container together with air. Because the mouth of the container is sealed after the toner mixed with air has filled the container, the packing density of the container is low, as stated above.

Moreover, the auger is apt to generate heat by friction while in rotation. The heat, as well as other factors, is considered to cause a plurality of toner particles to soften and bridge in the form of masses. When the masses of toner or so-called secondary particles are introduced into the developing unit of the image forming apparatus, they bring about various troubles including toner blocking and defective development.

In parallel with the miniaturization of the apparatus body, there is an increasing demand for a miniature toner container. In addition, when the container is implemented as a cartridge, it is also required to have a long life and be easy to operate. However, a decrease in the size of the container directly translates into a decrease in the amount of toner which can be filled in the container, resulting in a decrease in the number of images available therewith. This requires the frequent replacement of the container.

To solve the above problems ascribable to the miniaturization, the toner may be filled in the container in a great amount, i.e., in a high density. However, not all the customer's needs cannot be met by the simple dense packing of toner in the container. The container densely packed with the toner is expected to replenish the toner continuously and smoothly into the developing unit, to avoid toner blocking and other troubles in the unit, and to thereby produce a number of images matching the amount of the toner. Of course, the container must ensure high image quality.

Furthermore, toner of smaller particle size is required in order to meet the increasing demand for images of higher definition. However, toner of smaller particle size causes its particles to cohere more easily when filled in the container. This makes it difficult to market the densely packed toner container.

Some different approaches to fill a great amount of toner in the container have been proposed in the past. For example, Japanese Patent Laid-Open Publication No. 4-311403 teaches a method which positively sucks air out of the container via a suction tube. Japanese Patent Laid-Open Publication No. 4-87901 discloses a method which fills the container with the toner by use of the previously stated auger scheme, and then causes the toner to naturally sediment over a long period of time. However, these implementations do not consider the smooth replenishment of the toner into the developing unit, the number and quality of images available with the toner, or high-definition images. Of course, the containers particular to such implementations cannot solve the above problems.

Thus, a densely packed toner container meeting the above various demands has not been proposed or put on the market.

SUMMARY OF THE INVENTION

It is therefore an object of the present invention to provide a densely packed toner container capable of replenishing toner continuously, evenly and smoothly into the developing unit of an image forming apparatus and thereby forming a number of images matching the amount of the toner filling the container, and a method of producing the same.

It is another object of the present invention to provide a densely packed toner container for an image forming apparatus and capable of forming quality images, and a method of producing the same.

It is still another object of the present invention to provide a densely packed toner container for an image forming apparatus and capable of forming high-definition images, and a method of producing the same.

It is yet another object of the present invention to provide an image forming method capable of forming quality and high-definition images by use of a densely packed toner container.

It is a further object of the present invention to provide an image forming apparatus operable with a densely packed toner container.

In accordance with the present invention, in a toner container for replenishing toner to an image forming apparatus, the toner is packed in the toner container with a ratio of a packing density to a saturation bulk density greater than 1.0, a mean penetration greater than 5.0 mm inclusive, and a standard deviation of penetration not exceeding one-fifth of the mean penetration.

Also, in accordance with the present invention, a method of producing a toner container for replenishing toner to an image forming apparatus has the steps of inserting an air suction tube having a sucking portion at the end thereof into the toner container, which has a toner inlet for filling the toner and a hole for inserting the air suction tube, as far as a position close to the bottom of the toner container, introducing the toner into the toner container while blowing air into the toner container via the toner inlet, and sucking air out of the toner container via the air suction tube, and shifting the level of the sucking portion in accordance with the amount of the toner sequentially introduced into the toner container. The toner is packed in the toner container with a ratio of a packing density to a saturation bulk density greater than 1.0, a mean penetration greater than 5.0 mm inclusive, and a standard deviation of penetration not exceeding one-fifth of the mean penetration.

Further, in accordance with the present invention, a method of producing a toner container for replenishing toner to an image forming apparatus has the steps of inserting an air suction tube having a sucking portion at the end thereof into the toner container, which has a toner inlet for filling the toner and a hole for inserting the air suction tube, as far as a position close to the bottom of the toner container, introducing the toner into the toner container while blowing air intermittently into the toner container via the toner inlet at a rate of 30 cc/min to 200 cc/min, and sucking air out of the toner container via the air suction tube, and shifting the level of the sucking portion in accordance with the amount of the toner sequentially introduced into the toner container.

Furthermore, in accordance with the present invention, in an electrophotographic image forming apparatus operable with toner replenishing means in the form of a toner container packed with toner, the toner is packed in the toner container with a ratio of a packing density to a saturation bulk density greater than 1.0, a mean penetration greater than 5.0 mm inclusive, and a standard deviation of penetration not exceeding one-fifth of the mean penetration.

Moreover, in accordance with the present invention, in an electrophotographic image forming method using a toner container packed with toner and mounted to a developing unit, the toner is packed in the toner container with a ratio of a packing density to a saturation bulk density greater than 1.0, a mean penetration greater than 5.0 mm inclusive, and a standard deviation of penetration not exceeding one-fifth of the mean penetration.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

Figure 1:
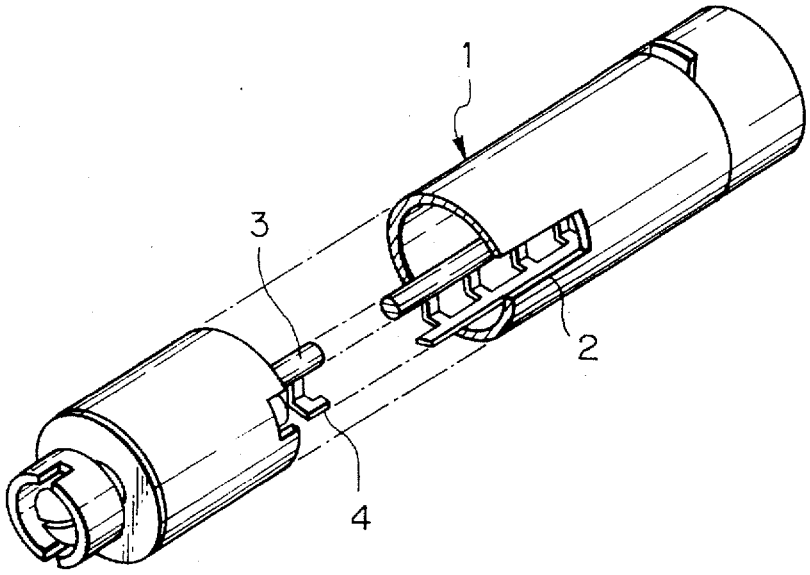
FIG. 1 is a partly taken away perspective view showing a specific configuration of a toner container.

We conducted a series of researches and experiments with a conventional toner container to see how the packing condition of toner in the container influences the replenishment of toner into a developing unit and therefore the quantity and quality of the resulting images.

Japanese Patent Laid-Open Publication No. 4-311403, for example, proposes a powder packing device having a powder container and a suction pipe positioned in the container. We experimentally caused the powder packing device to positively suck air in powder packed in the container through the suction pipe. The experiment showed that the packing density increases around the sucking portion of the pipe. However, the overall packing density was not so high as the expected density because the air was not fully separated from the powder. Moreover, the powder is caused to form hollow portions and portions pressed together in the container, resulting in an irregular packing condition.

If the packing condition of the toner in the toner container is irregular, it is likely that the toner is replenished into the developing unit in a great amount at a time, or in an excessive amount as a whole, or in a short amount.

When the portions of the toner pressed together are fed into the developing unit in a great amount at a time, there increases the amount of defectively charged toner in the developing unit and therefore the amount of toner consumption for a single image. As a result, despite that the container is packed with a great amount of toner, the number of pictures available with the toner is reduced. Further, tightly pressed portions are apt to form masses or secondary particles which also reduce the number of copies available with the toner.

When the toner is replenished in an excessive amount, it is apt to cause blocking and form secondary particles. The secondary particles not only aggravate toner blocking and background contamination, but also results in defective images which are partly lost in the form of stripes.

When the amount of toner supply is short, the image density is lowered to, in turn, render the operation of the developing unit defective.

Extended studies and experiments showed that the previously stated objects of the present invention are achievable if the toner is filled in the container with a particular packing density and a particular penetration.

A toner container in accordance with the present invention is characterized in that toner densely packed in the container has a ratio of a packing density to a saturation bulk density greater than 1.0, a mean penetration greater than 5.0 mm inclusive, and a standard deviation of penetration not exceeding one-fifth of the mean penetration.

The terms "packing density" refer to a value produced by dividing the weight of toner filled in the container by the volume of the container. The terms "saturation bulk density"

refer to the weight of toner for a unit volume and measured when the toner is filled in the container and then caused to naturally sediment over 24 hours. The penetration is calculated in accordance with JIS (Japanese Industrial Standards) K2207. The terms "mean penetration" refer to the mean value of penetrations measured at five or more points of a single toner container which are 4 cm spaced from each other. The number of points to be measured depends on the size and shape of the container. For the measurement of penetrations, the above points of the container may be perforated, cut open or cut off in such a manner as not to effect the packing condition of the toner. To perforate the container, the container may be clamped and then perforated by a hand drill. To cut open or cut off the container, use may be made of an ultrasonic cutter for a plastic container or an ordinary cutter for a paper container.

The terms "standard deviation" refer to a value produced by an equation:

$$\text{standard deviation}=[\{n\Sigma x_n^2-(\Sigma x_n)^2\}/n(n-1)]$$

where x and n denote the measured value and the number of measurements, respectively.

In accordance with the present invention, the toner filling the container has the ratio of the packing density to the saturation bulk density greater than 1.0, the mean penetration greater than 5.0 mm inclusive, and the standard deviation of penetration not exceeding one-fifth of the mean penetration, as stated earlier. In this condition, the toner can be packed in the container in an amount at least twice the conventional amount. Moreover, when an image forming apparatus is operated with the container mounted to its developing unit, the number of images available with the container is comparable with or even greater than, for a given weight of toner, the number of images available with the conventional container despite the far greater amount of toner. In addition, quality images free from irregular density distributions and background contamination are achievable.

With the above toner packing conditions, the container of the present invention allows substantially the entire toner to contribute to image formation in the form of primary particles without blocking or forming secondary particles in the container or during the course of image formation. The container with such a capability is produced by a new method which we have already proposed in Japanese Patent Laid-Open Publication No. 10910. The new method will be described specifically later.

In accordance with the present invention, the ratio of the packing density to the saturation bulk density should be greater than 1.0, preferably greater than 1.1 inclusive. If this ratio is less than 1.0, the toner cannot be density packed in the container. As for single-ingredient type magnetic toner, the true specific gravity is high, so that the saturation bulk density is apt to increase. Hence, the effect of dense packing is less noticeable with the above toner than with two-ingredient type toner. In light of this, the above ratio should preferably be greater than 1.125.

Mean penetrations less than 5.0 are not desirable because blocking occurs even if the standard deviation does not exceed one-fifth of the mean penetration. To further enhance the image quality, it is desirable that the mean penetration be greater than 10.0 mm inclusive. This is particularly true when high definition images are formed by fine toner powder.

Standard deviations of penetration exceeding one-fifth of the mean penetration are not desirable because they cause blocking to occur.

In accordance with the present invention, the toner to be packed in the container has a volume mean particle size of 4.0 μm to 12.0 μm, preferably 5.0 μm to 9.0 μm. Particle sizes less than 4.0 μm are apt to prevent image transfer and cleaning following image formation from being executed in an expected manner. Particle sizes greater than 12.0 μm make it difficult to maintain the resolution of images high. For high definition images, it is preferable that the volume mean particle size be as small as 9.0 μm or below.

As to the particle size distribution, it is preferable that less than 20%, inclusive, of the entire toner in terms of the number of particles be 4.0 μm or below, and that less than 30%, inclusive, of the entire toner in terms of weight be 12.7 μm or above. Such a range of particle size distribution allows the toner to be evenly packed in the container and promotes desirable replenishment and image quality.

A specific particle size distribution in accordance with the present invention is as follows.

(1) Toner with volume mean particle size of 7.5 μm 4.0 μm or smaller fine powder: 18% of the entire toner in terms of the number of particles 12.7 μm or greater rough powder: 15% in terms of weight (2) Toner with volume mean particle size of 9.0 μm 4.0 μm or smaller fine powder: 15% in terms of the number of particles 12.7 μm or greater rough powder: 2.0% in terms of weight The number of particles and the weight of the toner were measured by a particle size meter COULTER TA-2 (Trade Name) available from Coulter.

The present invention is practicable with any kind of toner applicable to an electrophotographic image forming method. While the toner consists of a styrene resin, polyester resin or similar binder resin and a coloring agent and, if necessary, a charge control agent, the present invention is not limited thereto. As for a single-ingredient type magnetic toner, a ferrite- or magnetite-based magnetic material is added. Magnetic powder to be mixed with two-ingredient type toner is also implemented by the above magnetic material. The toner may be black or of any chromatic color for use in a full-color process.

Desirable development is not attainable if the force by which the toner is attracted toward a developing roller included in a developing unit is excessive or short. In the case of single-ingredient type toner, the above force depends on the content of the magnetic material of the toner. Hence, for single-ingredient type toner, the true specific gravity should preferably be 1.55 to 1.75.

It has been customary to produce toner by kneading the above components together, pulverizing the resulting mixture, and then classifying the resulting powder to a desired particle size. An alternative method which has been recently introduced consists in polymerizing a monomer constituting a resin, and coloring the resulting polymer later.

While the container of the present invention has at least a toner outlet, its mechanism, shape, size and so forth are open to choice, i.e., they depend on the mechanism, size and so forth of a developing unit and those of an image forming apparatus. The container may be formed of, e.g., plastics or paper.

Specific configurations of the container in accordance with the present invention will be described hereinafter.

Figure 2:
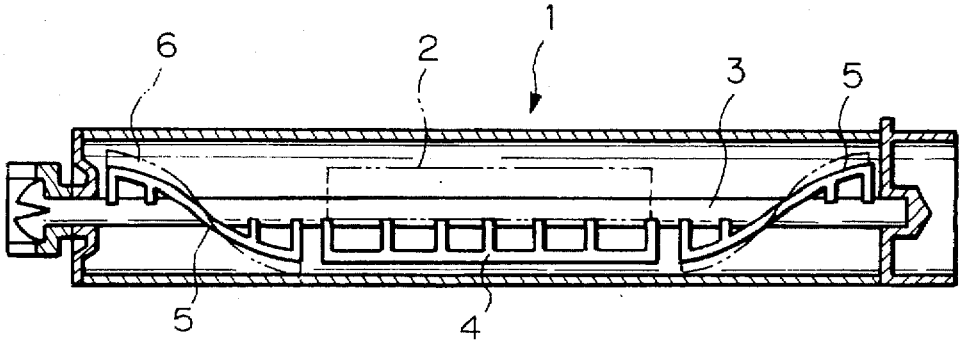
FIG. 2 is a section of the toner container shown in FIG. 1.

FIGS. 1 and 2 show a miniaturized toner container. As shown, the container, generally 1, has a toner outlet 2, a rotary shaft 3, a loosening plate 4, raking plates 5, and flexible members 6. The loosening plate 4 is mounted on the shaft 3 in order to replenish toner into a developing unit more stably from the container in which the toner is packed in the previously stated desirable condition. Specifically, the loosening plate 4 extends radially from the intermediate portion of the shaft 3 which is rotatably disposed in the container 1. The raking plates 5 are mounted on opposite end portions of the shaft 3, and each has a spiral configuration. The toner outlet 2 is implemented as a slot and formed through the wall of the container 1 in the longitudinal direction. When the shaft 3 is rotated, the loosening plate 4 drives the toner out of the container 1 via the slot 2. The toner is replenished into a developing unit, not shown.

The container 1 may additionally be provided with a toner inlet for filling the toner in the container 1 and a suction port or tube for promoting the filling of the toner, although not shown in FIGS. 1 and 2.

Figure 3:
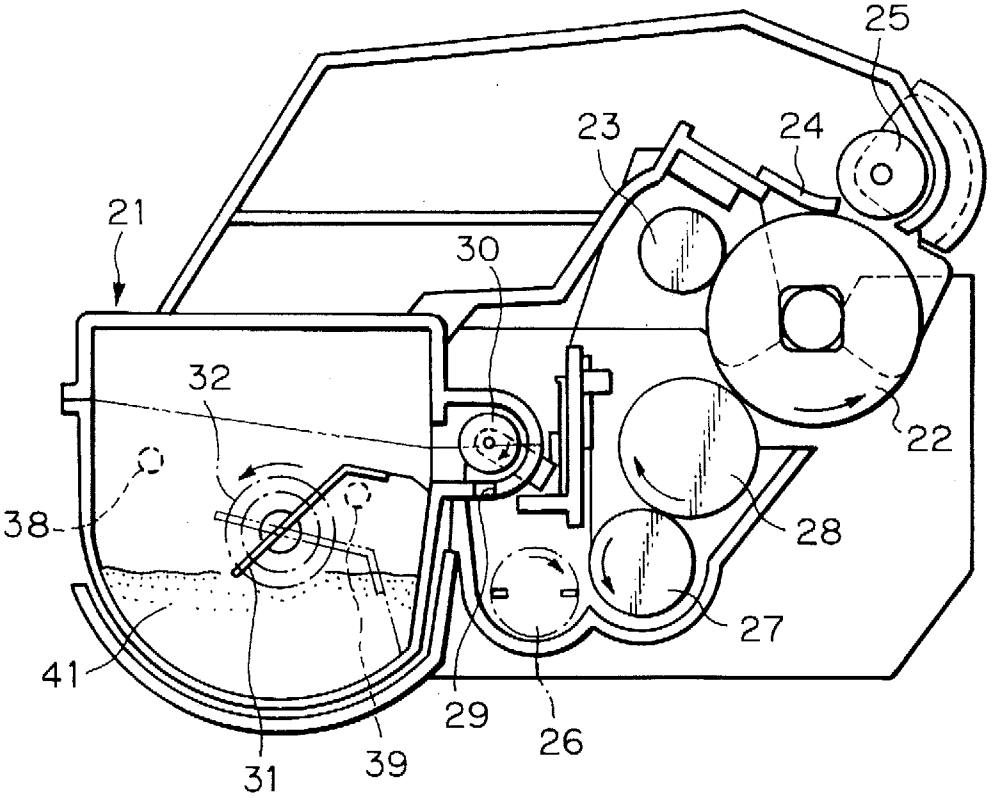
FIG. 3 is a section of an image forming apparatus including a developing unit, photoconductive element and other units joining in image formation, and to which another specific configuration of the toner container is applied.
Figure 4:
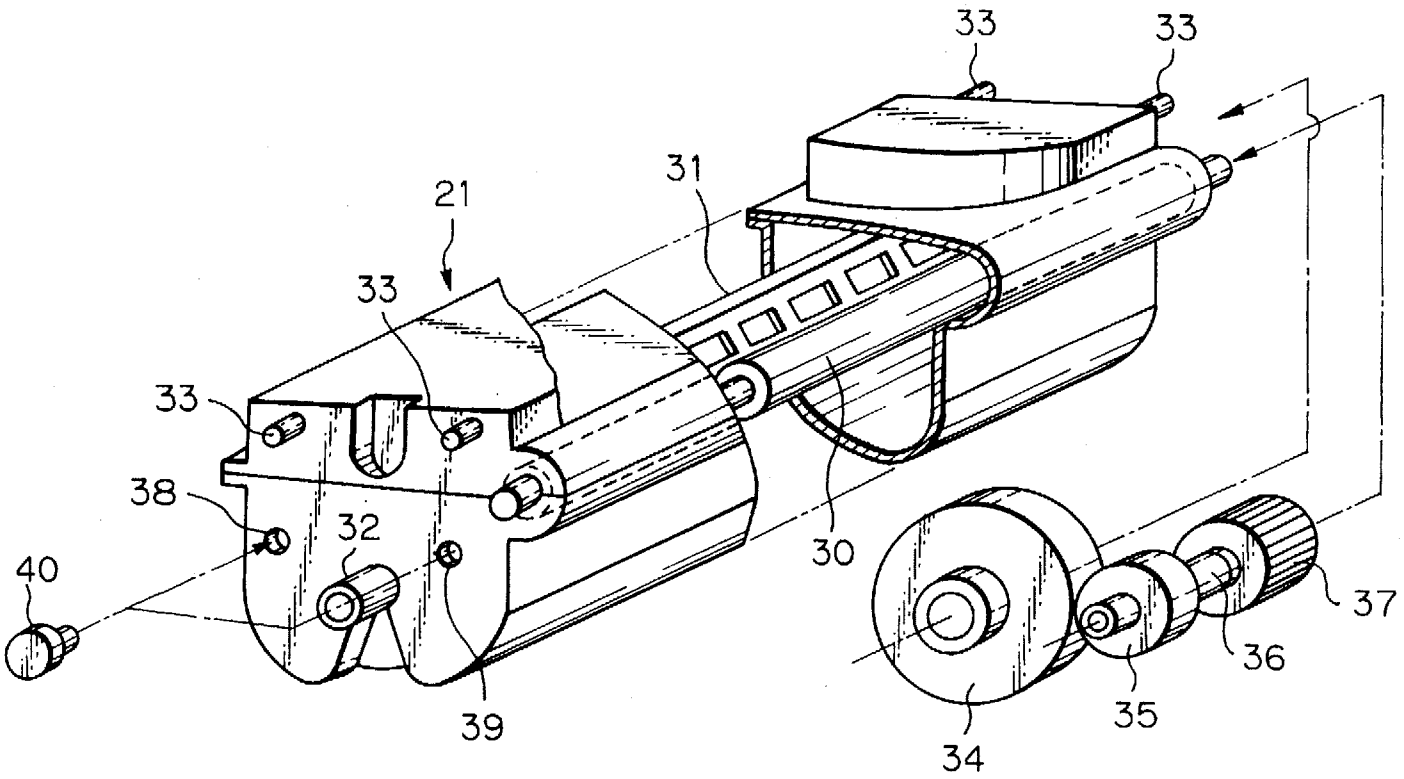
FIG. 4 is a perspective view showing still another configuration of the toner container.

FIG. 3 shows an image forming apparatus including a developing unit, photoconductive element and other units joining in image formation; an image transfer unit and a fixing unit are not shown. Another specific configuration of the container in accordance with the present invention is applied to the apparatus of FIG. 3. FIG. 4 is an external view of the container. There are shown in FIGS. 3 and 4 a toner container 21, a photoconductive element 22 in the form of a drum, a charge roller 23, a cleaning blade 24, a toner collecting roller 25, an agitator 26, a developing roller 28, an intermediate roller 27 intervening between the agitator 26 and the developing roller 28, a toner outlet 29, a replenishing roller 30, a loosening member 31, bearings 32, support pins 33, a gear 34 operatively connected to the loosening member 31, a gear 35 operatively connected to a drive source, a connecting member 36, a thumb piece 37, a toner inlet 38, a suction port 39, a cap 40, and toner 41.

As shown in FIG. 3, a cleaning unit is disposed above the drum 22. The charge roller 23 is held in contact with the drum 22 and enclosed by the cleaning unit. In the cleaning unit, the cleaning blade 24 scrapes off the toner left on the surface of the drum 22. The toner collecting roller 25 collects the toner from the blade 24. A developing unit has the agitator 26 for agitating the toner while feeding it to the intermediate roller 27. The intermediate roller 27 and developing roller 28 cooperate to feed the toner to the drum 22 while charging it by friction. When the amount of the toner 41 present in the container 21 decreases, the replenishing roller 30 is rotated to replenish the toner 41 from the container 21 via the outlet 29.

As shown in FIG. 4, the toner inlet 38 for filling the toner in the container 21 and suction port 39 for sucking air at the time of toner filling are formed in the container 21 in addition to the toner outlet 29. If the toner inlet 38 is excessively great, then the toner will be fed into the container 21 in an excessive amount for a unit time and will fail to sufficiently sediment. To cause the toner to sufficiently sediment, the diameter of the inlet 38 should preferably be smaller than 5 mm inclusive. If the suction port 39 is excessively great, then air will be sucked out of the container 21 in a greater amount than it will be fed into the container 21, obstructing the smooth filling of the toner. To match the outflow and inflow of air in amount, it is preferable that the diameter of the suction port 39 be smaller than 5 mm inclusive.

The loosening member 31 is disposed in the container 21 and rotatably supported by the bearings 32 at opposite ends thereof. The edge of the member 31 is held in contact with the inner periphery of the container 21. The support pins 33 are studded on the upper portions of opposite ends of the container 21 in order to ensure the accurate and stable mounting of the container 21 to the developing unit. The loosening member 31 and replenishing roller 30 parallel to each other are rotated by the gears 34 and 35 meshing each other.

Figure 5:
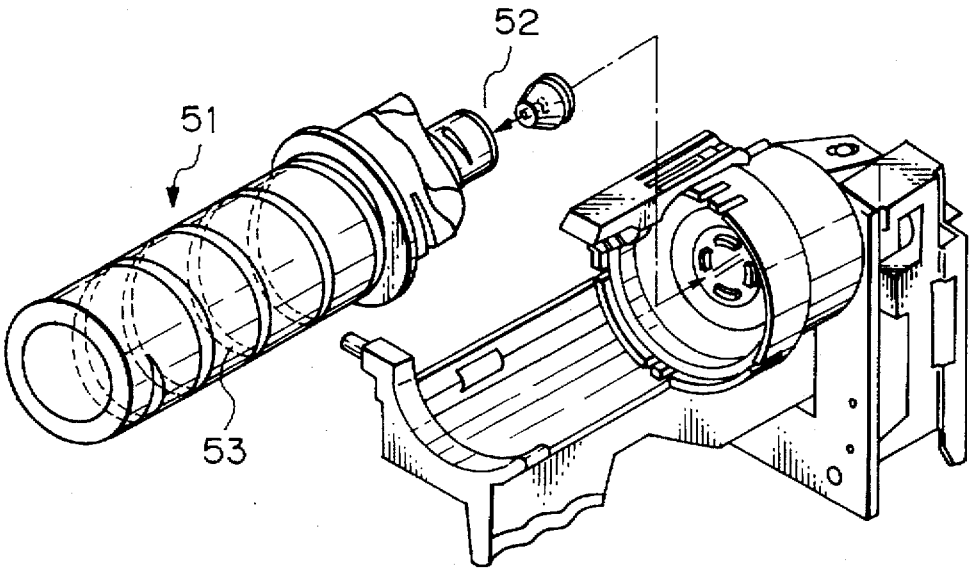
FIGS. 5 and 6 are perspective views showing a toner container of the type bodily rotatable to replenish toner.
Figure 6:
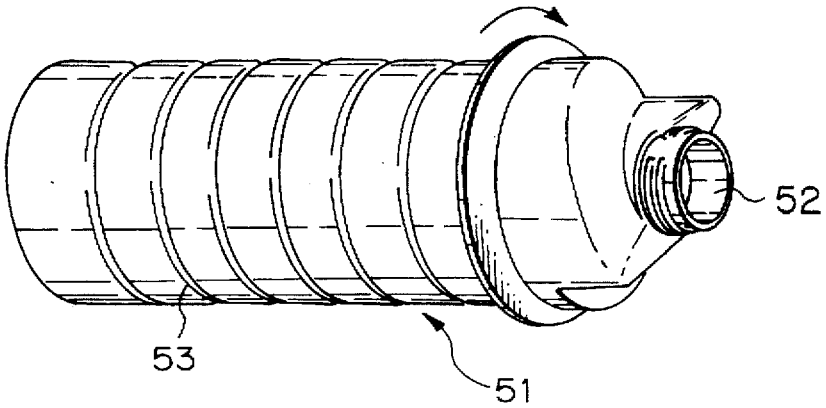

In the above specific configurations, the toner is driven toward the toner outlet 29 by the rotatable member. FIGS. 5 and 6 show another specific configuration in which the container is bodily rotatable in the event of replenishment.

As shown in FIGS. 5 and 6, a hollow cylindrical toner container 51 has a body portion and a mouth portion smaller in diameter than the body portion and protruding from one end of the body portion. A toner outlet 52 is formed in the mouth portion. A spiral ridge 53 is formed on the inner circumferential wall of the container 51. The container 51 filled with toner is set substantially horizontally on a holder, not shown, such that the toner outlet 52 is oriented sideways. Subsequently, the container 51 is bodily rotated. As a result, the spiral ridge 53 drives the toner existing on the bottom of the container 51 toward the outlet 52.

The container 51 is filled with toner via its toner outlet 52. Alternatively, when the air suction scheme is used, the container 51 may be formed with a toner inlet and a suction port in addition to the toner outlet 52. The suction port may be replaced with a hole for inserting a suction tube, as will be described later.

Hereinafter will be described a specific method of producing the densely packed toner container in accordance with the present invention.

Figure 7:
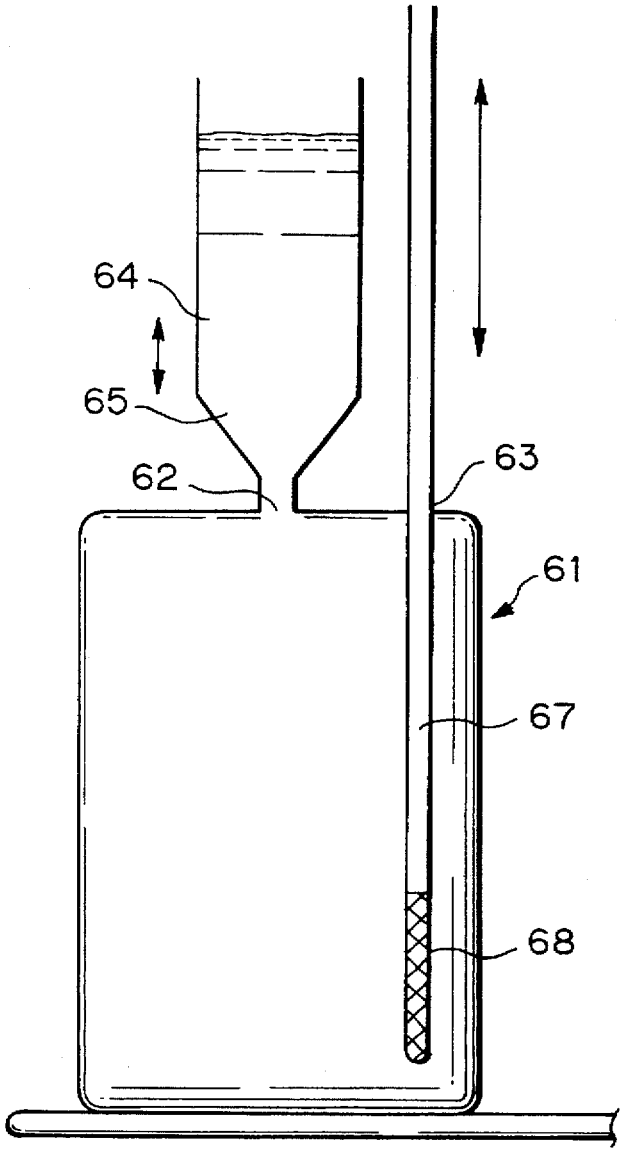
FIGS. 7 and 8 show how a densely packed toner container embodying the present invention is produced, and an apparatus for the production.
Figure 8:
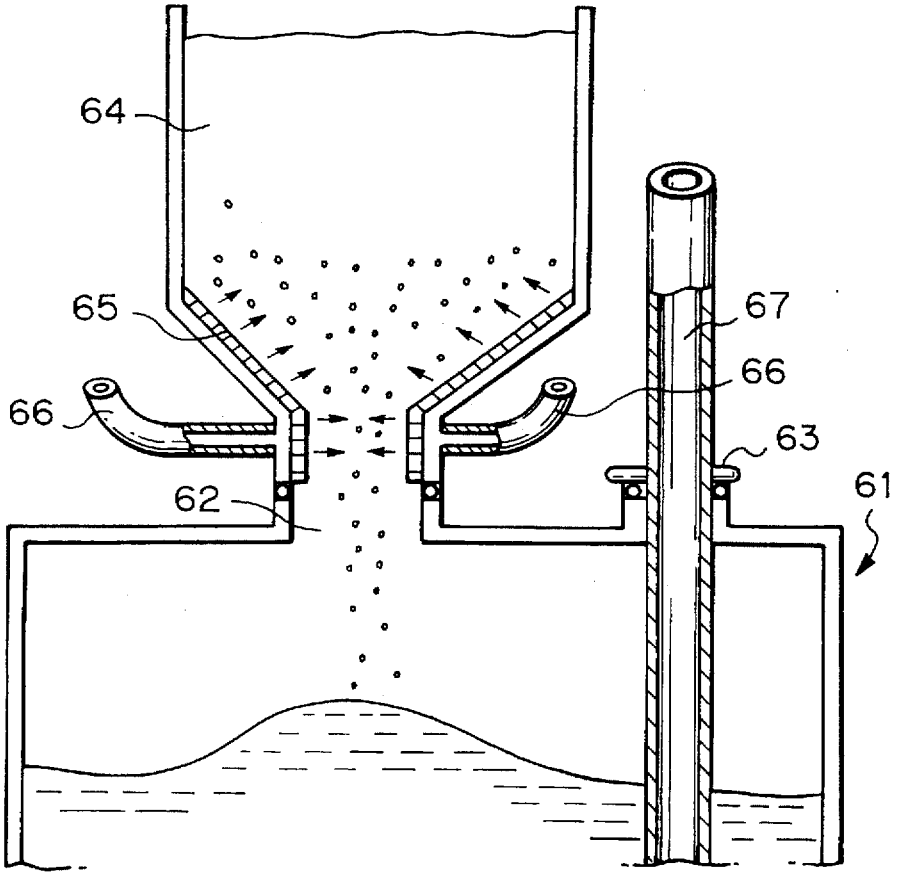

FIGS. 7 and 8 show an apparatus for producing the densely packed toner container of the present invention. It is to be noted that the toner outlet of the container is not shown in FIGS. 7 and 8. As shown, a toner container 61 has a toner inlet 62 and a hole 63 for the insertion of a suction tube 67 in the top thereof, as viewed in the figures. The toner inlet 62 and hole 63 each has a diameter of 5.0 min. A hopper 64 is connected to the toner inlet 62 via a packing made of silicone rubber. The hopper 64 is formed of stainless steel and has an inside diameter of 2.1 mm at its portion adjoining the toner inlet 62. The bottom portion and a part 65 of the side wall of the hopper 64 are implemented by an air-permeable member made of copper and formed with pores whose mean diameter is 27 μm. Air under pressure is fed from a compression source, not shown, to the hopper 64 via pipings 66 and the wall 65 of the hopper 64. The inclined inner surface of the hopper 64 has an angle of about 30 degrees with respect to the direction in which toner drops.

A suction tube 67 has an inside diameter of 4.2 mm and is inserted into the container 61 through the hole 63. The tube 67 has a sucking portion 68 at its tip which has an outside diameter of 5.0 mm and a length of 60 mm. The sucking portion 68 is implemented by a 3,000 mesh filter formed of porous stainless steel. The tube 67 is movable up and down by being driven by conventional means, not shown. The other end of the tube 67 is communicated to a decompression source, not shown.

The container 61 is produced by the above apparatus, as follows. The hopper 64 is filled with an adequate amount of toner. The toner begins to be fed from the hopper 64 into the container 61 while air is blown into the hopper 64 via the air-permeable wall 65. Specifically, air is fed into the hopper 64 intermittently at a rate of 30 cc to 200 cc/min, preferably 50 cc to 70 cc/min. At the same time, air is sucked out of the container 61 via the sucking portion 68 of the tube 67. The sucking portion 68 has its level or height changed in accordance with the amount of toner sequentially fed into the container 61. The level of the sucking portion 68 may be changed stepwise between the initial level and one or more levels higher than the initial level, or may be changed steplessly from the initial level. The suction pressure acting via the tube 67 is −600 mmHg to −50 mmHg, preferably −250 mmHg to −100 mmHg. After the container 61 has been filled with the toner, the tube 67 is pulled out of the container 61, and the hopper 64 is removed from the container 61. Subsequently, the toner inlet 62 and hole 63 are sealed.

The air flowing into the hopper 64 via the air-permeable wall 65 causes a convection to occur in the hopper 64. The convection increases the fluidity of the toner and thereby effectively obviates toner blocking in the vicinity of the toner inlet 62 which would lead to secondary particles. As a result, the toner can be smoothly fed from the hopper 64 to the container 61 in a loose state. Moreover, because the sucking portion 68 of the tube 67 is raised stepwise or steplessly to suck air at each level, the packing density is free from irregularity ascribable to, e.g., cohesion of the toner.

In the above method, a desirable toner filling condition is achievable by adjusting or changing the flow rate of air, suction pressure, and the elevation of the tube 67 in relation to each other.

Embodiments of the toner container in accordance with the present invention will be described hereinafter.

First, conditions for the production of the toner container and conditions for the measurement and evaluation of various physical properties will be described.

1. Measurement of Saturation Bulk Density

The measurement is effected in a constant temperature chamber held at a temperature of 20° C. and a humidity of 40%. Equipment for measurement and samples are used after they have been put in the same environment for about 3.5 hours. A preselected amount of toner (300 g) is put in a beaker. A 1-litter messcylinder (code No. 2350-1000A available from Shibata Kagaku (Japan) and having an outside diameter of 70 mm) is weighed and then placed still. The toner in the beaker is slowly introduced into the messcylinder via a funnel such that it does not fly about. Subsequently, the top of the messcylinder is closed by a polyethylene wrapping. On the elapse of 24 hours, the graduation of the messcylinder flush with the top of the toner is read in order to determine the volume of the toner. The weight of the toner in the messcylinder is determined on the basis of the difference in weight. A saturation bulk density is produced by an equation:

weight of toner in messcylinder/volume of toner=saturation bulk density

2. Toner Container Samples

1) Kinds of Containers (1) Containers each having a toner inlet and a hole for a suction tube are used:

(i) Container for single-ingredient type magnetic toner (container A): A polystyrene container of the same type as the container shown in FIGS. 3 and 4 is used. The container has a cubic configuration which is 26.5 cm long, 8.0 cm thick, and 5.5 cm wide (volume of 385 cc).

(ii) Container for two-ingredient type magnetic toner (container B): A polyethylene container of the same type as the container shown in FIGS. 5 and 6 and having a toner inlet and a hole for a suction tube is used. The container has a cylindrical configuration having a length of 42.0 cm and a diameter of 10.3 cm (volume of 2,810 cc).

(2) For the measurement of penetrations, the containers A and B are respectively formed with six holes and ten holes in their portions which will face upward when mounted to an image forming apparatus. The holes are spaced 4 cm from each other in the longitudinal direction of the containers, and each has a diameter of about 4 mm. Thereafter, the containers are cleaned by air.

2) Kinds of Toner (1) As for a single-ingredient type toner, there are used single-ingredient toner for a facsimile machine RIFAX 100L (trade name and available from Ricoh (Japan); mean particle size of 7.3 μm) (toner a), its three derivatives different in particle size (mean particle sizes of 5.0 μm, 6.0 μm and 9.0 μm) (toners b, c and d), toner for a laser printer LPS-20 (trade name and available from Ricoh; mean particle size of 11.5 μm) (toner e), and its derivative different in particle size (mean particle size of 10.0 μm) (toner f).

(2) As for a two-ingredient type toner, there are used toner for a copier SPIRIO 6000 (trade name and available from Ricoh; mean particle size of 9.1 μm) (toner g), and toner for a copier FT 3300 (trade name and available from Ricoh; mean particle size of 11.5 μm) (toner h).

Table 1 shown below lists the particle size distributions of the above toners.

TABLE 1

| Toner | Volume Mean Particle Size (μm) | Smaller Than 4 μm (Number) | Greater Than 12.7 μm (Weight) |
|---|---|---|---|
| a | 7.3 | 18.0% | 1.0% |
| b | 5.0 | 19.0% | 1.0% |
| c | 6.0 | 19.0% | 1.0% |
| d | 9.0 | 17.0% | 1.5% |
| e | 11.5 | 14.0% | 2.5% |
| f | 10.0 | 15.0% | 2.0% |
| g | 9.1 | 18.0% | 2.0% |
| h | 11.5 | 15.0% | 2.0% |

3) Toner Packing (1) Sample Nos. 1–15 (examples of the present invention) are produced by the apparatus shown in FIG. 7. Air is blown into the hopper 64 via the wall 65 intermittently in the direction substantially perpendicular to the direction in which the toner drops. Specifically, air is fed into the hopper 64 once every second at a rate of 55 cc/min. On the other hand, air is sucked out by a vacuum of −250 mmHg to −100 mmHg. The sucking portion 68 of the tube 67 is initially held at a height which is one-fourth of the height of the container as measured from the bottom. When one half of the toner is fed from the hopper 64 to the container, the sucking portion 68 is raised to a height which is three-fourths of the height of the container. The sucking portion 68 is held at this height until the packing of the toner ends. When the tube 67 is raised, the feed and suction of air are interrupted. The packing time is 6 seconds.

As for the container B, the sucking portion 68 is initially held at a height which is one-sixth of the height of the container as measured from the bottom. When one-third of the toner is fed from the hopper 64 to the container, the sucking portion 68 is raised to a height which is one half of the height of the container. Subsequently, when two-thirds of the toner is transferred form the hopper 64 to the container, the sucking portion 68 is raised to a height which is five-sixths of the height of the container. The sucking portion 68 is held at this height until the filling of the toner ends. Again, when the tube 67 is raised, the feed and suction of air are interrupted. The packing time is 40 seconds.

(2) Sample Nos. 16 and 20 (comparative examples) are produced in the same manner as the sample Nos. 1–15 except that the vacuum for air suction is −350 mmHg.

(3) A sample 17 (comparative example) is produced in the same manner as the sample Nos. 1–15 except that the tube 67 is not raised.

(4) Sample Nos. 18 and 19 (comparative examples) are produced without air suction. Toner is filled in the container from a hopper using an auger.

3. Measurement of Penetrations

A tape is removed from the container filled with toner. A penetrometer PENETROMETER (trade name and available from Nikkaki (Japan)) is used to insert a needle into the container through a hole in accordance with JIS K2207, thereby measuring a penetration. Specifically, the needle is inserted into the hole of the container such that it adjoins, but does not contact, the edge of the hole. The needle i s illuminated by, e.g., a flashlight via the hole. The tip of the needle is brought into contact with the surface of the toner layer with the shadow of the needle being watched by eye. A rack for the measurement of a penetration is brought into contact with the top of a needle holder, and then the indicator of a dial gauge is moved to zero. A clasp is operated by hand so as to let the needle to fall. Subsequently, the rack is slowly lifted to the top of the needle holder, and then the dial gauge is read.

Penetrations and their mean values determined with the various samples are listed in Table 4.

4. Number of Images (Toner Yield)

The number of images available with a single toner container, i.e., a toner yield is measured. As for single-ingredient type toner, an electrophotographic image forming apparatus is implemented by RIFAX-TYPE2400L (trade name and available from Ricoh) is used. As for two-ingredient type toner, use is made of SPIRIO 6000.

First, the following operation is performed in order to reduce the influence of toner remaining in the developing section of the image forming apparatus. A sufficient amount of toner is supplied from a toner container into the apparatus. Then, a test pattern consisting of characters and a mesh image and having an area ratio of 6% is continuously formed on plain papers of size A4 without the replenishment of the toner. The image formation is ended when a toner end condition is displayed or when the image density begins to fall.

For the measurement of a toner yield, the above container is removed from the apparatus, and then a test toner container is set at a preselected position. In this condition, the above test pattern is continuously formed on plain papers of size A4. The image formation is ended when a toner end condition is displayed or when the image density begins to fall. This procedure is ended after the absence of the toner in the container has been confirmed.

The papers on which the test patterns were continuously formed with the test container are counted. Values below a hundred are omitted. The number of papers for the amount of toner (g) is calculated.

5. Evaluation of Image Quality

Every 100th paper or image is picked up to evaluate it as to background contamination, irregularity in image density, and quality of high-definition image by use of a ×15 loupe, as follows:

1) Background contamination is evaluated in four ranks. A double circular, a circle, a triangle and a cross respectively show that no contamination occurred throughout the image formation, that some contamination occurred when the papers were stared at, that about 10% of the papers were contaminated, and that the papers were obviously contaminated.

2) Irregularity in image density is evaluated in two ranks.

3) The quality of a high definition image is evaluated as to character reproducibility and mesh reproducibility. Regarding character reproducibility, the sharpness and resolution of characters are evaluated in four ranks. The local omission, thickening and distortion of lines and the smearing of spaces between lines are determined to be defects. A double circle, a circle, a triangle and a cross respectively show that character reproducibility was good throughout the image formation, that local omission and blurring occurred when the papers were stared at, that they occurred on more than 10% of the papers, and that the reproducibility was obviously poor.

Regarding mesh reproducibility, the tonality and evenness of a photograph portion is evaluated in four ranks. Irregular halftone portions and distorted images are determined to be defective. A double circular, a circle, a triangle and a cross respectively show that mesh reproducibility was good throughout the image formation, that irregular density and distortion occurred when the papers are stared at, that more than 10% of the papers were defective, and that the reproducibility was obviously poor.

The results of the above experiments are listed in Tables 2, 3 and 4. In Table 2, sample Nos. 1–15 and sample Nos. 16–20 are respectively representative of the examples of the present invention and comparative examples. Sample Nos. 1–10 and Nos. 16–18 relate to single-ingredient type toner while sample Nos. 11–15, 19 and 20 relate to two-ingredient type toner. Specifically, Table 2 shows the packing conditions, volume, bulk density of each sample while Table 3 shows the number of copies obtained with each sample and the result of evaluation.

TABLE 2

| | Sample No. | Mean Particle Size (μm) | Sat Bulk Density | Container | Packed Amount (g) | Packing Density | True Specific Gravity | Vacuum (mmHg) | Volume (cc) |
|---|---|---|---|---|---|---|---|---|---|
| Ex. 1 | 1 | 7.5 | 0.64 | A | 340 | 0.88 | 1.65 | −250.0 | 385 |
| Ex. 2 | 2 | 7.5 | 0.64 | A | 278 | 0.72 | 1.65 | −200.0 | 385 |
| Ex. 3 | 3 | 7.5 | 0.64 | A | 271 | 0.70 | 1.65 | −150.0 | 385 |
| Ex. 4 | 4 | 7.5 | 0.64 | A | 259 | 0.67 | 1.65 | −100.0 | 385 |
| Ex. 5 | 5 | 5.0 | 0.64 | A | 271 | 0.70 | 1.65 | −150.0 | 385 |
| Ex. 6 | 6 | 6.0 | 0.64 | A | 271 | 0.70 | 1.65 | −150.0 | 385 |
| Ex. 7 | 7 | 9.0 | 0.64 | A | 271 | 0.70 | 1.65 | −150.0 | 385 |
| Ex. 8 | 8 | 11.0 | 0.68 | A | 288 | 0.75 | 1.65 | −250.0 | 385 |
| Ex. 9 | 9 | 11.5 | 0.68 | A | 340 | 0.88 | 1.65 | −200.0 | 385 |
| Ex. 10 | 10 | 11.5 | 0.68 | A | 314 | 0.82 | 1.65 | −350.0 | 385 |
| Comp. Ex. 1 | 16 | 7.5 | 0.64 | A | 365 | 0.95 | 1.65 | −200.0 | 385 |
| Comp. Ex. 2 | 17 | 7.5 | 0.64 | A | 185 | 0.48 | 1.65 | 0.0 | 385 |
| Comp. Ex. 3 | 18 | 7.5 | 0.64 | A | 136 | 0.35 | 1.65 | −250.0 | 385 |
| Ex. 11 | 11 | 11.5 | 0.40 | B | 1484 | 0.53 | 1.22 | −200.0 | 2810 |
| Ex. 12 | 12 | 11.5 | 0.40 | B | 1383 | 0.49 | 1.22 | −200.0 | 2810 |
| Ex. 13 | 13 | 9.1 | 0.39 | B | 1534 | 0.55 | 1.22 | −250.0 | 2810 |

TABLE 2-continued

| | Sample No. | Mean Particle Size (μm) | Sat Bulk Density | Container | Packed Amount (g) | Packing Density | True Specific Gravity | Vacuum (mmHg) | Volume (cc) |
|---|---|---|---|---|---|---|---|---|---|
| Ex. 14 | 14 | 9.1 | 0.39 | B | 1479 | 0.53 | 1.22 | −200.0 | 2810 |
| Ex. 15 | 15 | 9.1 | 0.39 | B | 1260 | 0.45 | 1.22 | −150.0 | 2810 |
| Comp. Ex. 4 | 19 | 9.1 | 0.39 | B | 548 | 0.20 | 1.22 | 0.0 | 2810 |
| Comp. Ex. 5 | 20 | 9.1 | 0.39 | B | 1589 | 0.57 | 1.22 | −350.0 | 2810 |

TABLE 3

| | Yield (Copies/ Container) | Background Contamination | Character Repro-ducibility | Mesh Repro-ducibility | Irregular Density | Toner Comsumption (g/A4) | Number of Copies/g |
|---|---|---|---|---|---|---|---|
| Ex. 1 | 6400 | ○ | ○ | ○ | none | 0.053 | 18.8 |
| Ex. 2 | 5700 | ○ | ◎ | ◎ | none | 0.049 | 20.5 |
| Ex. 3 | 5500 | ◎ | ◎ | ◎ | none | 0.049 | 20.3 |
| Ex. 4 | 5000 | ◎ | ◎ | ◎ | none | 0.052 | 19.3 |
| Ex. 5 | 5100 | ◎ | ◎ | ◎ | none | 0.053 | 18.8 |
| Ex. 6 | 5500 | ◎ | ◎ | ◎ | none | 0.049 | 20.3 |
| Ex. 7 | 5400 | ◎ | ◎ | ◎ | none | 0.050 | 19.9 |
| Ex. 8 | 5700 | ◎ | Δ | Δ | none | 0.051 | 19.8 |
| Ex. 9 | 6400 | ◎ | Δ | Δ | none | 0.053 | 18.8 |
| Ex. 10 | 5900 | ◎ | Δ | Δ | none | 0.053 | 18.8 |
| Comp. Ex. 1 | 5600 | x | x | x | occurred | 0.065 | 15.4 |
| Comp. Ex. 2 | 3000 | Δ | Δ | ○ | occurred | 0.062 | 16.2 |
| Comp. Ex. 3 | 2500 | ○ | ◎ | ○ | none | 0.054 | 18.4 |
| Ex. 11 | 39000 | ○ | Δ | Δ | none | 0.038 | 26.3 |
| Ex. 12 | 35100 | ◎ | Δ | Δ | none | 0.039 | 25.4 |
| Ex. 13 | 38000 | ○ | ○ | ○ | none | 0.040 | 24.8 |
| Ex. 14 | 37500 | ○ | ◎ | ◎ | none | 0.039 | 25.3 |
| Ex. 15 | 32800 | ◎ | ◎ | ◎ | none | 0.038 | 26.0 |
| Comp. Ex. 4 | 13500 | ○ | ○ | ○ | none | 0.041 | 24.6 |
| Comp. Ex. 5 | 33100 | x | x | x | occurred | 0.048 | 20.8 |

TABLE 4

| | Pack Density/Sat Bulk Density | Pene-tration 1 | Pene-tration 2 | Pene-tration 3 | Pene-tration 4 | Pene-tration 5 | Pene-tration 6 | Pene-tration 7 | Pene-tration 8 | Pene-tration 9 | Pene-tration 10 | Mean | Standard Deviation | ⅕ of Mean |
|---|---|---|---|---|---|---|---|---|---|---|---|---|---|---|
| Ex. 1 | 1.38 | 12.0 | 9.0 | 10.5 | 12.0 | 10.0 | 9.0 | — | — | — | — | 10.4 | 1.36 | 2.08 |
| Ex. 2 | 1.13 | 15.0 | 14.0 | 15.0 | 13.5 | 14.5 | 15.0 | — | — | — | — | 14.5 | 0.63 | 2.90 |
| Ex. 3 | 1.10 | 28.0 | 31.5 | 30.0 | 33.0 | 29.0 | 28.5 | — | — | — | — | 30.0 | 1.92 | 6.00 |
| Ex. 4 | 1.05 | 37.5 | 38.5 | 40.0 | 35.0 | 38.5 | 40.5 | — | — | — | — | 38.3 | 1.97 | 7.67 |
| Ex. 5 | 1.10 | 25.0 | 26.0 | 29.0 | 27.0 | 30.0 | 26.0 | — | — | — | — | 27.2 | 1.94 | 5.43 |
| Ex. 6 | 1.10 | 28.0 | 26.5 | 29.5 | 31.0 | 27.0 | 26.0 | — | — | — | — | 28.0 | 1.92 | 5.60 |
| Ex. 7 | 1.10 | 29.5 | 31.0 | 30.0 | 32.0 | 29.0 | 29.5 | — | — | — | — | 30.2 | 1.13 | 6.03 |
| Ex. 8 | 1.10 | 10.0 | 11.0 | 9.0 | 10.0 | 11.0 | 9.0 | — | — | — | — | 10.0 | 0.89 | 2.00 |
| Ex. 9 | 1.30 | 11.0 | 9.0 | 10.0 | 12.0 | 9.0 | 10.0 | — | — | — | — | 10.2 | 1.17 | 2.03 |
| Ex. 10 | 1.20 | 13.0 | 13.5 | 16.0 | 12.5 | 15.0 | 15.5 | — | — | — | — | 14.3 | 1.44 | 2.85 |
| Comp. Ex. 1 | 1.48 | 3.0 | 2.0 | 2.5 | 3.0 | 4.0 | 3.0 | — | — | — | — | 2.9 | 0.66 | 0.58 |
| Comp. Ex. 2 | 0.75 | 3.0 | 5.0 | 31.0 | 38.0 | 41.0 | 40.0 | — | — | — | — | 26.3 | 17.66 | 5.27 |
| Comp. Ex. 3 | 0.55 | unmeasurable due to penetration to bottom | | | | | | | | | | | | |
| Ex. 11 | 1.32 | 9.0 | 11.0 | 10.5 | 12.0 | 9.0 | 9.5 | 11.0 | 10.0 | 10.0 | 11.0 | 10.3 | 0.98 | 2.06 |
| Ex. 12 | 1.23 | 10.5 | 13.0 | 10.0 | 14.0 | 11.5 | 11.0 | 13.5 | 10.0 | 11.0 | 11.0 | 11.6 | 1.44 | 2.31 |
| Ex. 13 | 1.40 | 6.0 | 7.0 | 8.0 | 7.5 | 7.0 | 6.0 | 6.0 | 8.0 | 7.5 | 8.0 | 7.1 | 0.84 | 1.42 |
| Ex. 14 | 1.35 | 12.5 | 11.0 | 13.0 | 13.0 | 11.0 | 11.0 | 13.5 | 11.5 | 13.0 | 11.0 | 12.1 | 1.04 | 2.41 |
| Ex. 15 | 1.15 | 34.5 | 33.0 | 35.5 | 37.0 | 35.0 | 35.0 | 36.5 | 35.0 | 34.0 | 36.0 | 35.1 | 1.22 | 7.02 |
| Comp. Ex. 4 | 0.50 | unmeasurable due to penetration to bottom | | | | | | | | | | | | |
| Comp. Ex. 5 | 1.45 | 3.5 | 4.0 | 3.0 | 2.0 | 2.0 | 3.0 | 3.5 | 4.0 | 2.5 | 3.0 | 3.1 | 0.72 | 0.61 |

Tables 2–4 clearly indicate the following. The examples 1–10 and comparative examples 1–3 both using the container A will be discussed for comparison. The examples 1–10 satisfy all the necessary conditions, i.e., the packing density/saturation bulk density ratio greater than 1.0, mean penetration greater than 5.0 mm inclusive, and standard deviation of penetration not exceeding one-fifth of the mean penetration. Therefore, the examples 1–10 are excellent as to toner yield, image quality, toner consumption, and the number of copies. Particularly, in the examples 1–7 using toner whose volume mean particle size is 5.0 μm to 9.0 μm, character reproducibility, mesh reproducibility and other factors of image quality are more desirable than in the examples 8–10. Hence, the examples 1–7 are sufficiently adaptive to high definition applications.

By contrast, the penetration achievable with the comparative example 1 is as small as 2.9 mm although the packing density/saturation bulk density ratio is greater than 1.0. Hence, the comparative example 1 is low not only in image quality but also in the number of copies. The comparative example 2 has a packing density/saturation bulk density ratio smaller than 1.0, and a mean penetration greater than 5.0 mm. However, because the mean deviation of penetration is far greater than one-fifth of the mean penetration, the comparative example 2 is low in toner yield, slightly low in image quality, and small in the number of copies despite the great toner consumption. Further, the comparative example 3 whose packing density/saturation bulk density ratio is far smaller than the other is critically low in toner yield, although it is acceptable as to image quality, toner consumption, and the number of copies.

It will be seen from the above that the examples 1–10 of the present invention are superior to the comparative examples 1–3.

The examples 11–15 and comparative examples 4 and 5 both using the container B compare as follows. The examples 11–15 satisfy all the necessary conditions, i.e., the packing density/saturation bulk density ratio greater than 1.0, mean penetration greater 5.0 mm inclusive, and standard deviation of penetration not exceeding one-fifth of the mean penetration. Therefore, the examples 11–15 are excellent as to toner yield, image quality, toner consumption, and the number of copies.

By contrast, the comparative example 4 whose packing density/saturation bulk density ratio is critically small is far lower in toner yield than the others, although it is acceptable as to image quality, toner consumption, and the number of copies. The comparative example 5 has a packing density/saturation bulk density ratio greater than 1.0, but its penetration is as small as 3.1 mm. Hence, the comparative example 5 is extremely low in image quality although its toner yield is acceptable.

As the above comparison indicates, the examples 11–15 of the present invention are superior to the comparative examples 4 and 5.

The influence of heat hysteresis after the packing of toner was determined with each of the examples and comparative examples by the following procedures:

(1) letting the container alone for 12 hours after filling, and then measuring a penetration;

(2) letting the container alone for 12 hours after filling, shaking it ten times to the right and left by hand, and then measuring a penetration; and (3) placing the container in a 50° C. constant temperature bath after filling, removing it from the bath, and then measuring a penetration in 2 hours, i.e., when it is restored to room temperature.

It was found that heat hysteresis after the filling of toner has substantially no influence.

Figure 9:
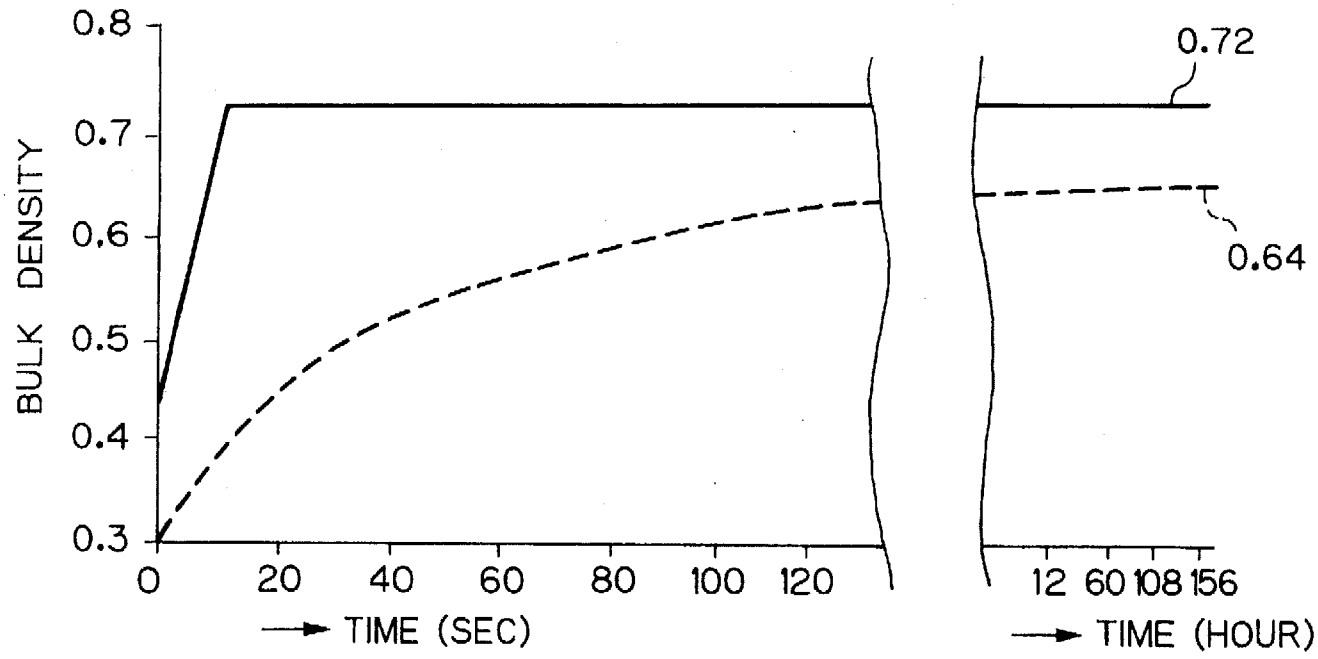
FIG. 9 shows curves respectively representative of a procedure for filling a specific sample of the present invention with toner, and a procedure for filling a container with the same toner by causing the toner to naturally sediment over a long period of time substantially to saturation.

FIG. 9 shows curves respectively representative of the packing procedure particular to the sample No. 2 and the procedure in which the same toner is filled in a container and let alone for a long period of time until it substantially reaches saturation. As shown, the packing density available with the present invention is 0.72 g/cc while the saturation bulk density density particular to the natural sedimentation scheme is as low as 0.64 g/cc. In addition, the present invention is far greater in the number of copies than the natural sedimentation scheme and is comparable with or even superior to the latter as to image quality.

In summary, in accordance with the present invention, a densely packed toner container is capable of replenishing toner continuously, evenly and smoothly to a developing unit, so that a number of copies matching the amount of toner packed in the container can be produced. The container of the present invention has a toner yield twice the toner yield of a conventional toner container of the same type and volume.

Despite the dense packing of toner, the container of the present invention ensures high image quality and high definition images.

While the densely packed container of the present invention may be stored in the same temperature and humidity environment as conventional low density containers, it should preferably be stored at a temperature lower than room temperature and at a lower humidity.

Various modifications will become possible for those skilled in the art after receiving the teachings of the present disclosure without departing from the scope thereof.

What is claimed is:

1. A toner container for replenishing toner to an image forming apparatus, wherein said toner is packed in said toner container with a ratio of a packing density to a saturation bulk density greater than 1.0, a mean penetration greater than 5.0 mm inclusive, and a standard deviation of penetration not exceeding one-fifth of said mean penetration.

2. A toner container as claimed in claim 1, wherein said toner has a volume mean particle size of 4.0 μm to 12.0 μm.

3. A toner container as claimed in claim 1, wherein said toner has a volume mean particle size smaller than 9.0 μm inclusive.

4. A toner container as claimed in claim 3, less than 20%, inclusive, of said toner in terms of a number of particles have a particle size smaller than 4.0 μm inclusive while less than 3.0%, inclusive, of said toner in terms of weight have a particle size greater than 12.7 μm inclusive.

5. A toner container as claimed in claim 1, wherein the penetration is greater than 10.0 mm inclusive.

6. A toner container as claimed in claim 1, wherein the ratio of the packing density to the saturation bulk density is greater than 1.1 inclusive.

7. A toner container as claimed in claim 1, wherein said toner comprises single-ingredient type magnetic toner having a volume mean particle size of 5.0 μm to 9.0 μm, and wherein the ratio of the packing density to the saturation bulk density is greater than 1.125.

8. A toner container as claimed in claim 7, wherein less than 20%, inclusive, of said toner in terms of a number of particles have a particle size smaller than 4.0 μm inclusive while less than 3.0%, inclusive, of said toner in terms of weight have a particle size greater than 12.7 μm inclusive.

9. A toner container as claimed in claim 1, wherein said toner has a true specific gravity of 1.55 to 1.75.

10. A toner container as claimed in claim 1, wherein a rotatable member for loosening said toner is disposed in said toner container.

11. A toner container as claimed in claim 1, wherein said toner container is formed with a toner outlet for replenishing said toner, a toner inlet for packing said toner in said toner container, and one of an air suction port and a hole for inserting an air suction tube.

12. A method of producing a toner container for replenishing toner to an image forming apparatus, comprising the steps of:

inserting an air suction tube having a sucking portion at an end thereof into said toner container, which has a toner inlet for packing said toner and a hole for inserting said air suction tube, as far as a position close to a bottom of said toner container;

introducing said toner into said toner container while blowing air into said toner container via said toner inlet, and sucking air out of said toner container via said air suction tube; and shifting a level of said sucking portion in accordance with an amount of said toner sequentially introduced into said toner container;

wherein said toner is packed in said toner container with a ratio of a packing density to a saturation bulk density greater than 1.0, a mean penetration greater than 5.0 mm inclusive, and a standard deviation of penetration not exceeding one-fifth of said mean penetration.

13. A method of producing a toner container for replenishing toner to an image forming apparatus, comprising the steps of:

inserting an air suction tube having a sucking portion at an end thereof into said toner container, which has a toner inlet for packing said toner and a hole for inserting said air suction tube, as far as a position close to a bottom of said toner container;

introducing said toner into said toner container while blowing air into said toner container intermittently via said toner inlet at a rate of 30 cc/min to 200 cc/min, and sucking air out of said toner container via said air suction tube; and shifting a level of said sucking portion in accordance with an amount of said toner sequentially introduced into said toner container.

14. An electrophotographic image forming apparatus operable with toner replenishing means in a form of a toner container packed with toner, wherein said toner is packed in said toner container with a ratio of a packing density to a saturation bulk density greater than 1.0, a mean penetration greater than 5.0 mm inclusive, and a standard deviation of penetration not exceeding one-fifth of said mean penetration.

15. An electrophotographic image forming method using a toner container packed with toner and mounted to a developing unit, wherein said method includes packing said toner container with a ratio of a packing density to a saturation bulk density greater than 1.0, a mean penetration greater than 5.0 mm inclusive, and a standard deviation of penetration not exceeding one-fifth of said mean penetration.

* * * * *